United States Patent [19]

Seelenbinder et al.

[11] 4,158,495

[45] Jun. 19, 1979

[54] DEVELOPER APPARATUS FOR DIAZOTYPE COPY MATERIALS

[75] Inventors: Terry G. Seelenbinder, Elk Grove Village; Walter A. Hudson, Fox River Grove; Eugene P. Oddo, Mt. Prospect, all of Ill.

[73] Assignee: AM International, Inc., Los Angeles, Calif.

[21] Appl. No.: 916,221

[22] Filed: Jun. 16, 1978

[51] Int. Cl.[2] ..... G03D 5/06

[52] U.S. Cl. ..... 354/318; 354/324; 118/248; 118/261

[58] Field of Search ..... 354/318, 324; 118/248, 118/261; 101/365, 363, 350

[56] References Cited

U.S. PATENT DOCUMENTS

| | | | |
|---|---|---|---|
| 3,596,635 | 8/1971 | Smitzer | 354/318 |
| 3,913,479 | 10/1975 | Cappel et al. | 101/365 |
| 3,969,742 | 7/1976 | McCabe | 354/318 |
| 3,978,788 | 9/1976 | Cappel et al. | 101/363 |
| 4,084,510 | 4/1978 | Schweitzer et al. | 101/365 |

*Primary Examiner*—L. T. Hix
*Assistant Examiner*—Alan Mathews
*Attorney, Agent, or Firm*—Michael A. Kondzella; George Jameson; Robert S. Hulse

[57] ABSTRACT

A developer apparatus is provided for developing exposed diazotype copy sheets comprising an applicator roller, means for supplying liquid developer to the applicator roller, a metering blade for wiping excessive liquid from the applicator roller and a pressure blade for pressing a copy sheet against the surface of the applicator roller to transfer liquid from the applicator roller to the copy sheet to develop an image thereon. The metering and pressure blades are arranged for sliding movement between an inoperative position ineffective to develop the copy sheet and an operative position in pressure engagement with the applicator roller for developing the copy sheet. Cam and linkage control means is provided for sequentially moving the blades between the inoperative and operative positions under control of a manually operable actuating means.

11 Claims, 5 Drawing Figures

Fig. 3
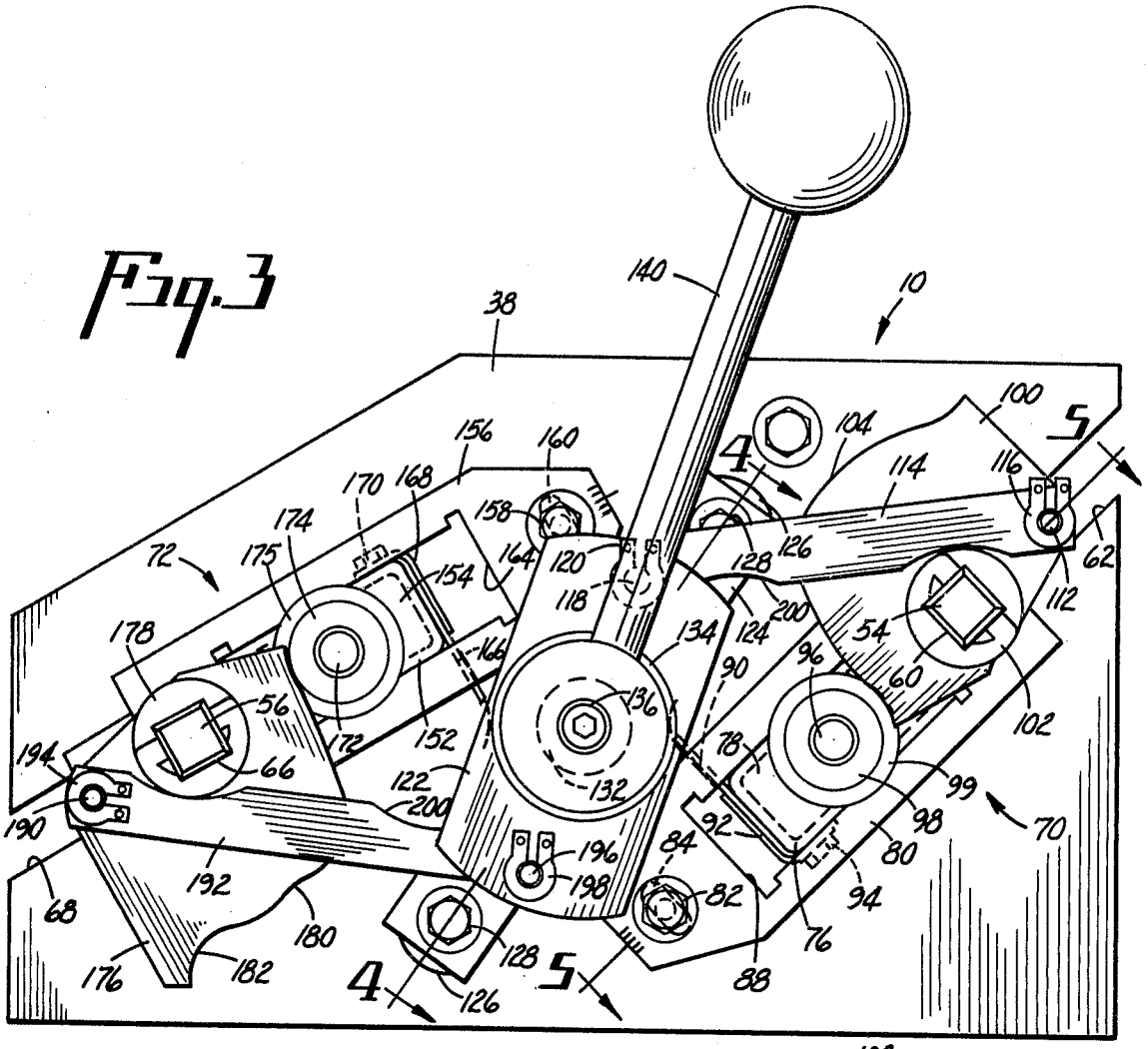
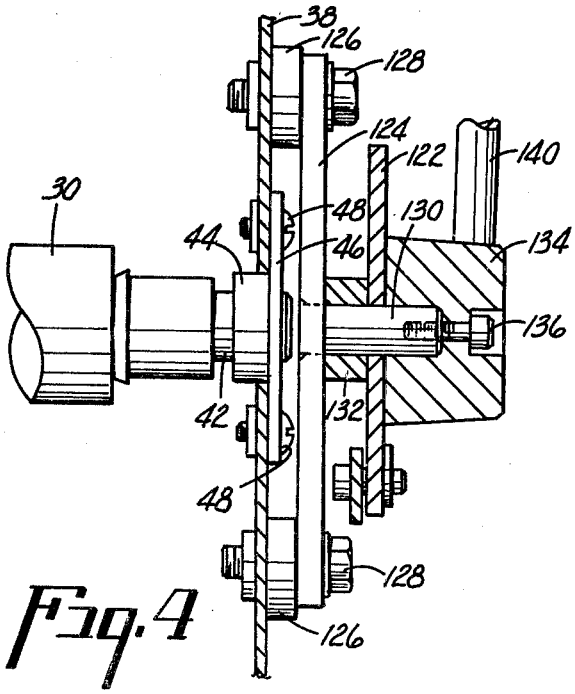
Fig. 4
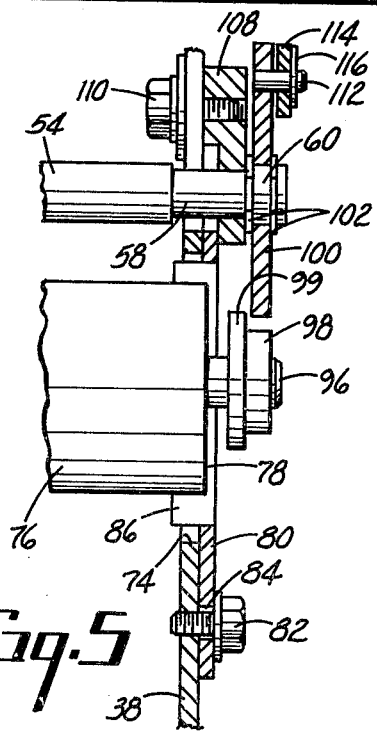
Fig. 5

DEVELOPER APPARATUS FOR DIAZOTYPE COPY MATERIALS

BACKGROUND OF THE INVENTION

The invention relates to a developer apparatus for developing diazotype copy sheets and, more particularly, to the operation and control of metering and pressure blades with which the developer apparatus is equipped for controlling, respectively, the amount of liquid developer applied to the roller's surface and the amount of pressure applied to the copy sheet as it passes through a developing zone between the pressure blade and the applicator roller for development.

Developer apparatuses equipped with metering and pressure blades for developing diazotype copy sheets by applying thereto metered quantities of liquid developer are disclosed, for example, in U.S. Pat. Nos. 3,702,096; 3,704,661; and 3,704,662, assigned to the assignee of the present invention. In these prior art devices, the metering and pressure blades are mounted for pivotal movement into and out of pressure engagement with the applicator roller. Movement of the blades is effected automatically by a cam control means which is fairly complex in construction and expensive to produce. In one of these devices, for example, the device requires mechanism comprising a drive system including two motors and special circuitry for each motor. Moreover, because of the space requirements for such mechanism, the device does not lend itself to the construction of a compact apparatus.

Another device is shown in U.S. Pat. No. 3,969,742 also assigned to the same assignee as the present invention, and comprises a series of gears for moving and controlling the metering and pressure blades. One of the gears is adapted for manual movement to render operative a sequence control gear for pivotally moving the blades into and out of engagement with the applicator roller. Also provided are linkage and latching members, switches and circuitry for maintaining the blades in engagement with the applicator roller and for triggering the motor for driving the applicator roller. Such a device is also complex in construction and expensive to manufacture. Further, the device does not provide for developing quality images on copy media of different materials and weights with only an initial setting of the blades with respect to the applicator roller, and requires independent pressure adjustment of the blades for each different copy media to be developed.

SUMMARY OF THE INVENTION

The present invention provides a developer apparatus comprising a cam and linkage control means and a manually operable actuating means for operating the control means for slidably moving the metering and pressure blades into pressure engagement with the applicator roller. The sliding movement of the blades, as opposed to pivotal movement of the blades as in the prior art devices, minimizes the torque requirements for positioning the blades against the applicator roller and, also, provides for increased adjustment whereby a single setting of the blades provides for development of quality images on copy media of paper or film. Each blade is also provided with a protective cover which reduces the service problems of the blades, reduces the cost by eliminating the need for a polishing operation of the blades as normally required in prior art devices and increases the useful life of the blades by reducing undue wear thereto.

The foregoing is attained by providing a developer apparatus in which the metering and pressure blades are each mounted in a slide means each associated with an adjustable support member for supporting the blades angularly and in diametrically opposed relation with respect to the applicator roller. The cam and linkage control means is mechanically connected with the slide means associated with each of the support members and with the actuating means for manually operating the cam and linkage control means. A cam means of the cam and linkage control means acts upon a cam follower roller provided on each of the slide means to effect movement of the blades into pressure engagement with the applicator roller in response to operation of the actuating means in a first direction, and effects movement of the pressure blade out of contact with the applicator roller and relieves the pressure of the metering blade against the applicator roller in response to operation of the actuating means in the opposite direction.

An object of the invention is to provide an improved developer apparatus which provides for slidably moving the metering and pressure blades into pressure engagement with the applicator roller for developing exposed copy sheets with a liquid developer.

Another object is to provide manually operable actuating means for moving the blades whereby the torque requirements for positioning the blades against the applicator roller are greatly minimized.

Another object is to provide for increased adjustment of the blades to provide for development of high quality images on different types of copy media with only a single setting of the blades.

Another object is to provide protective cover means for the blades to increase the life of the blades and reduce the cost of producing and servicing the blades.

A feature of the invention is to provide a developer apparatus which is simple in construction and operation, economical to produce and reliable in operation.

Other objects, features and advantages of the invention will appear hereinafter as the description proceeds.

IN THE DRAWING

FIG. 3 is a section taken on the line 3—3 of FIG. 1, on an enlarged scale, illustrating a cam and linkage control means and an actuating means for operating the same for moving the blades into and out of pressure engagement with the applicator roller;

FIG. 4 is a section taken on the line 4—4 of FIG. 3; and

FIG. 5 is a section taken on the line 5—5 of FIG. 3.

DESCRIPTION OF THE PREFERRED EMBODIMENT

Figure 1:
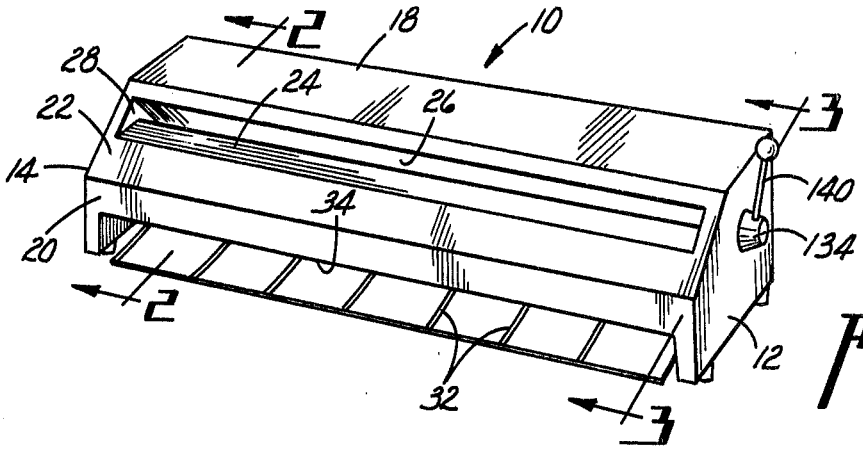
FIG. 1 is a front-right perspective view of a developer apparatus in accordance with the present invention.
Figure 2:
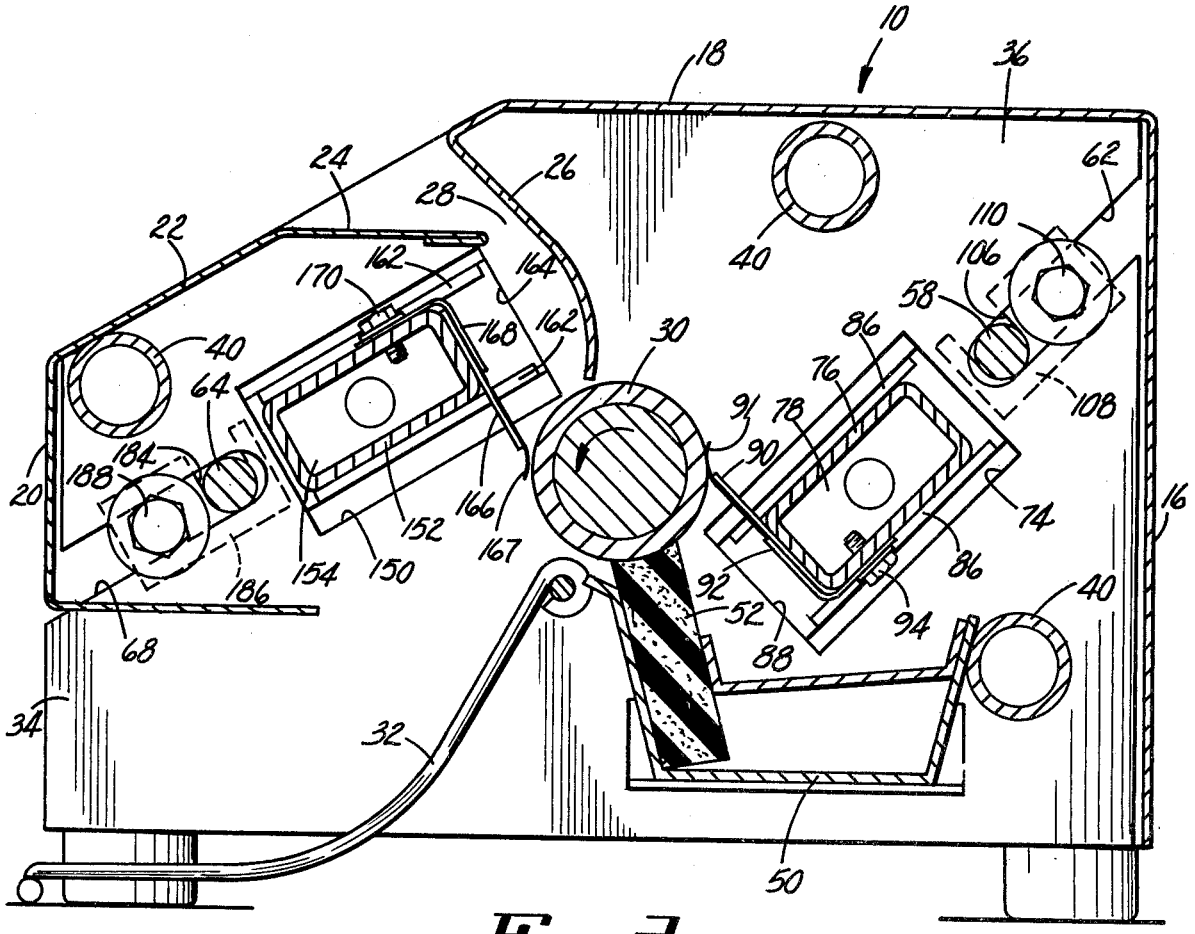
FIG. 2 is a section taken on the line 2—2 of FIG. 1, on an enlarged scale, showing the mounting arrangement of the metering and pressure blades.

With reference to FIGS. 1 and 2, there is shown a developer apparatus indicated generally by the reference numeral 10 comprising outside covers including end walls 12 and 14, a back wall 16, a top cover 18, a front wall 20 and a sloped front portion 22 extending from the front wall 20 to a shelf 24. The shelf 24 terminates adjacent a guide wall 26 depending from the top cover 18 and provides therebetween an inlet passage 28 for feeding an exposed diazotype copy sheet to be developed to an applicator roller 30. From the applicator roller 30, the developed copy sheet is delivered by guide means 32 to an outlet passage 34 at the front of the apparatus 10.

The developer apparatus 10 includes a pair of side plates 36 and 38, see FIGS. 2, 3, 4 and 5, held together in spaced apart parallel relation with a plurality of torque tubes 40 as shown in FIG. 2. As shown in FIG. 4, an axle 42 of the applicator roller 30 is journalled at each end in a bearing 44, secured to the side plate with a retainer member 46 and fasteners 48, for rotatably mounting the applicator roller in the side plates 36 and 38.

With reference to FIG. 2, there is shown a fountain 50 mounted between the side plates 36 and 38 for supplying liquid developer to the applicator roller 30 via a wick 52 extending from the fountain 50 to the surface of the applicator roller 30.

Also mounted in the side plates 36 and 38 are a pair of square shafts 54 and 56. The shaft 54 is provided with a turned portion 58 adjacent each end and a square end 60 at each end of the shaft 54 extends slightly beyond the side plates 36 and 38 by positioning the turned portions 58 in an open ended slots 62 provided in each of the side plates. Similarly, the square shaft 56 is provided with a turned portion 64 (FIG. 2) adjacent each end and a square end 66 at each end of the shaft 56 extends slightly beyond the side plates. The shaft 56 is retained in the side plates 36 and 38 by positioning the turned portions 64 in an open ended slot 68 provided in each of the side plates.

With reference to FIG. 3, there is shown a metering cam and linkage control means (MCLC) indicated generally by the reference numeral 70 and a pressure cam and linkage control means (PCLC) indicated generally by the reference numeral 72. Although the MCLC and PCLC are provided at both ends of the apparatus 10, because they are alike in construction and operation only the MCLC 70 and the PCLC 72 associated with the side plate 38 will be described in detail.

As shown in FIG. 2, the side plate 36 is provided with a rectangular opening 74 in alignment with a similar opening 74 provided in the side plate 38 as shown in FIG. 5. The openings 74 are positioned adjacent the applicator roller 30 and angularly thereto. A metering blade slide means 76, comprising a hollow tube having a rectangular cross section and closed ends 78, is mounted in the side plates 36 and 38 and is supported in the opening 74 by a support member 80.

The support member 80 is pivotally supported on the turned portion 58 of the square shaft 54 and is mounted for adjustment on the side plate 38 with a fastener 82 passing through an elongate slot 84 in the support member 80 and into a tapped hole in the side plate as best shown in FIGS. 3 and 5. With reference to FIGS. 2 and 5, the support member 80 provides a channel configuration by the formation of a pair of flanges 86 disposed at longitudinal edges of a rectangular opening 88 provided in the support member 80 as shown in FIGS. 2 and 3. The flanges 86 of the support member 80 mounted on the side plate 36 are shown in FIG. 2. The flanges 86 extend through the opening 74 in the side plate 38 as shown in FIG. 5. Also, and as shown in FIG. 2, the flanges 86 are spaced apart a distance less than the width of the opening 74 for purposes of adjustment as will be explained hereinbelow. The slide means 76 is closely fitted between the flanges 86 and is supported by the flanges for sliding movement thereon.

With reference to FIGS. 2 and 3, a metering blade 90 is mounted on the slide means 76 with a clamp 92 and a fastener 94. The metering blade 90 extends from the slide means 76 and terminates with a marginal edge thereof in contact with the surface of the applicator roller 30 along the axial length of the applicator roller. The weight of the slide means 76 acting downwardly causes the metering blade 90 to rest on the applicator roller 30 by gravity, defining an inoperative position of the metering blade 90. The angular position of the metering blade 90 relative to the applicator roller 30 is adjusted by loosening the fastener 82 and swinging the support member 80 towards or away from the applicator roller 30 about its pivot on the turned portion 58 on the square shaft 54. The amount of pivotal movement that may be imparted to the support member 80 is limited only by the amount of clearance provided between the flanges 86 of the support member 80 and the opening 88 in the side plate 38. In response to setting the metering blade 90 to the properly adjusted position, the fastener 82 is tightened to retain the metering blade in the set angular position.

Preferably, the metering blade 90 is fabricated of stainless steel so as to provide the required resiliency to cause deflection of the blade when it is moved into pressure engagement with the applicator roller 30 and, also, to provide resistance to attack by chemically reactive material such as the liquid developer.

To reduce the cost and increase the life of the metering blade 90 there is provided a protective strip or cover 91 covering the surface of the blade adapted to contact the surface of the applicator roller 30. As shown in FIG. 3, the protective cover 91 is mounted to the slide means 76 by the clamp 92 and extends beyond the marginal edge of the metering blade 90 and axially along the applicator roller 30 substantially the full length thereof. Preferably, the cover 91 is fabricated from polyester material. The use of the cover 91 eliminates the need for an expensive polishing operation of the metering blade 90 as normally required in prior art devices. Also, because the metering blade 90 is shielded by the cover 91 from frictional or rubbing contact with the applicator roller 30, the useful life of the metering blade is increased substantially and service problems resulting from undue wear of the metering blade are greatly reduced.

The closed end 78 of the slide means 76 is provided with a pin 96 for rotatably supporting a metering cam follower roller 98 positioned adjacent the outside face of the side plate 38. As shown in FIGS. 3 and 5, when the metering blade 90 is disposed in its inoperative position the metering cam follower roller 98 is spaced from a metering cam 100. The metering cam 100 is mounted on the square end 60 of the shaft 54 by retainers 102 and the metering cam follower roller 98 is provided with a shoulder 99 in interfering relation with the metering cam 100 to maintain the metering cam follower roller 98 on the pin 96, as shown in FIGS. 3 and 5. The metering cam 100 is adapted to be actuated or rotated between an inactive position shown in FIG. 3 and an active position in which a lobe 104 of the metering cam 100 acts against the metering cam follower roller 98 to thereby impart sliding movement to the slide means 76 to position the metering blade 90 into pressure contact or engagement with the surface of the applicator roller 30.

The amount of pressure exerted against the applicator roller 30 by the metering blade 90 is adjustable by positioning the square shaft 54 at a selected position in the open ended slot 62 in the side plate 38. As shown in FIGS. 2 and 5, the turned portion 58 of the shaft 54 is positioned in the open ended slot 62 and in an open ended slot 106 provided in a keeper 108 secured to the side plate 38 with a fastener 110. The slot 106 in the keeper 108 is positioned normal to the slot 62 in the side plate such that movement of the square shaft 54 towards or away from the closed end of the slot 62 respectively, also moves the metering cam 100 towards or away from the metering cam follower roller 98 respectively.

Movement of the metering cam 100 in a direction towards or closer to the metering cam follower roller 98, upon actuation of the metering cam 100 from its inactive to active position, also moves the slide means 76 in a direction towards the applicator roller 30 whereby the metering blade 90 applies an increased amount of pressure to the surface of the applicator roller. Conversely, movement of the metering cam 100 in a direction away from the metering cam follower roller 98, upon actuation of the metering cam 100 from the inactive to the active position, results in less movement being imparted to the slide means 76 whereby the metering blade 90 applies a decreased amount of pressure to the surface of the applicator roller 30. When the metering blade is set to apply proper pressure, through selective positioning of the square shaft 54 in the slot 62, the fastener 110 and the keeper 108 are effective to retain the shaft 54 in the set position.

The metering cam 100 is provided with a pin 112 for pivotally supporting one end of a link 114 which is held on the pin with a retainer 116 as shown in FIGS. 3 and 5. The other end of the link 114 is similarly mounted on a pin 118 provided in a fulcrum plate 122 and is held on the pin with a retainer 120 as shown in FIG. 3. With reference to FIGS. 3 and 4, a pivot support member 124 is positioned between the fulcrum plate 122 and the side plate 38 and is spaced from the side plate with spacers 126 and secured thereto with fasteners 128. The pivot support member 124 includes a pin 130 coaxial with the applicator roller 30 for supporting thereon a spacer 132, positioned between the pivot support member 124 and the fulcrum plate 122, and a hub 134 secured to the fulcrum plate. The fulcrum plate 122 is pivotally supported on the pin 130 with a fastener 136. As shown in FIG. 3, an actuating means or lever 140 is mounted on the hub 134 to provide for manually pivoting the fulcrum plate 122 and operating the MCLC 70 for actuating the metering cam 100 between the inactive and active positions.

The PCLC 72 is similar to the MCLC 70. Thus, the side plate 36 is provided with a rectangular opening 150 as shown in FIG. 2, in alignment with alike opening in the side plate 38 not shown in the drawing. The openings 150 are positioned adjacent and angularly to the applicator roller 30. A pressure blade slide means 152 is provided and comprises a hollow tube having rectangular cross section and closed ends 154. The slide means 152 is mounted in the side plates 36 and 38 and is supported in the openings 150 by a support member 156.

The support member 156 is pivotally supported on the turned portion 64 of the square shaft 56 and is adjustably mounted to the side plate 38 with a fastener 158 passing through a slot 160 in the support member 156 (FIG. 3) and into a tapped hole in the side plate. The support member 156 provides a channel configuration by the formation of a pair of flanges 162 (FIG. 2) disposed at longitudinal edges of a rectangular opening 164 provided in the support member as shown in FIGS. 2 and 3. As with the flanges 86 on the support member 80, the flanges 162 also extend through the opening 150 of the side plate 38 and are spaced apart a distance less than the width of the opening 150 for adjustment purposes. Also, the pressure slide means 152 is closely fitted between the flanges 162 and is supported by the flanges for sliding movement thereon.

As shown in FIGS. 2 and 3, a pressure blade 166 is mounted on the slide means 152 with a clamp 168 and a fastener 170. The pressure blade 166 extends from the slide means 152 and terminates with a marginal edge thereof adjacent the surface of the applicator roller 30 along the axial length of the applicator roller. The weight of the slide means 152 acting downwardly by gravity causes the pressure blade 166 to be maintained out of contact with the applicator roller, defining an inoperative position of the pressure blade 166. The angular position of the pressure blade 166 relative to the applicator roller 30 is adjusted by loosening the fastener 158 and swinging the support member 156 towards or away from the applicator roller 30 about the pivot provided by the turned portions 64 of the square shaft 56. The amount of movement of the support member 156 is limited only by the amount of clearance between the flanges 162 of the support member and the opening 150 in the side plate 38 as described above in respect to the support member 80. When properly positioned, the pressure blade 166 is maintained in the set position by the fastener 158.

As with the metering blade 90, the pressure blade 166 may also be fabricated of stainless steel. The pressure blade 166 is also provided with a protective cover or strip 167, as shown in FIG. 3, to protect the surface of the pressure blade adapted to contact the applicator roller 30. The strip 167 is mounted on the slide means 152 with the clamp 168.

The closed end 154 of the slide means 152 is provided with a pin 172 for rotatably supporting a pressure cam follower roller 174 at a position adjacent the outside face of the side plate 38. As shown in FIG. 3, with the pressure blade 166 in the inoperative position the pressure cam follower roller 174 rests on a pressure cam 176. The pressure cam 176 is mounted on the square end 66 of the shaft 56 with retainers 178 and the pressure cam follower roller 174 is provided with a shoulder 175 in interfering relation with the pressure cam 176 to maintain the pressure cam follower roller 174 on the pin 172, as shown in FIG. 3. The pressure cam 176 is adapted to be actuated or rotated from an inactive position illustrated in FIG. 3 to either one of two active positions in which a first lobe 180 or a second lobe 182 of the pressure cam 176 acts against the pressure cam follower roller 174 to impart movement to the slide means 152 for moving the pressure blade 166 into pressure contact or engagement with the surface of the applicator roller 30.

The first lobe 180 of the pressure cam 176 acting against the pressure cam follower roller 174 is designed to move the slide means 152 a distance less than the second lobe 182 acting against the pressure cam follower roller 174. Thus, the first lobe 180 acting against the pressure cam follower roller 174 results in the pressure blade 166 exerting less pressure against the applicator roller 30 than does the second lobe 182 acting against the pressure cam follower roller 174, and the pressure blade 166 exerts more pressure against the applicator roller 30 when the second lobe 182 acts against the cam follower roller 174. Accordingly, with but a single initial setting of the cam 176, the pressure blade 166 is effective to develop high quality images on either diazotype copy paper or film. Since a greater amount of pressure is required in the development of copy paper than is required in the development of film, the first lobe 180 provides for proper pressure of the pressure blade 166 for developing film and the lobe 182 provides for proper pressure of the pressure blade for developing copy paper.

The amount of pressure to be exerted by the pressure blade 166 against the applicator roller 30 is adjustable by selectively positioning the square shaft 56 in the open ended slot 68 provided in the side plate 38, as shown in FIGS. 2 and 3. The turn portion 64 of the shaft 56 is positioned in the open ended slot 68 and in an open ended slot 184 provided in a keeper 186 secure to the side plate with a fastener 188. The slot 184 in the keeper 186 is positioned normal to the slot 68 in the slide plate such that the shaft 56 may be moved towards and away from the closed end of the slot 68 respectively, to thereby move the cam 176 towards and away from the cam follower roller 174 respectively.

Movement of the pressure cam 176 towards or closer to the pressure cam follower roller 174, upon actuation of the pressure cam 176 from its inactive to active position, also moves the slide means 152 towards the applicator roller 30 resulting in the pressure blade 166 applying an increased amount of pressure to the applicator roller. Conversely, movement of the pressure cam 176 away from the pressure cam follower roller 174, upon actuation of the pressure cam 176 to the active position, results in less movement being imparted to the slide means 152 whereby the pressure blade 166 applies a decreased amount of pressure to the surface of the applicator roller 30. Following adjustment of the pressure blade 166 to obtain proper pressure, through selective positioning of the square shaft 56 in the slot 68, the pressure blade 166 is maintained in the set position by the fastener 188 and the keeper 186.

As shown in FIG. 3, the pressure cam 176 includes a pin 190 for pivotally supporting one end of a link 192 which is held on the pin with a retainer 194. The other end of the link 192 is similarly mounted on a pin 196 provided in the fulcrum plate 122 and is held on the pin with a retainer 198. The links 114 and 192 are each provided with a recess 200, as shown in FIG. 3, to provide clearance of the links with the spacer 132 in response to actuation of the MCLC 70 and PCLC 72 and actuation of the cams 100 and 176 between the inactive and active positions. The other recess provided in the links is not required for clearance purposes and is merely to facilitate symmetrical fabrication of the links 114 and 192.

As mentioned earlier, the MCLC 70 and the PCLC 72 are provided at both ends of the developer apparatus 10 and are alike in construction and operation. However, since operation of the apparatus is controlled by the single lever 140 from only one end of the apparatus, parts corresponding to the links 114 and 192 and the operating lever 140 are not required at the opposite end of the apparatus adjacent the side plate 36. Thus, through manual actuation of the lever 140 and operation of the MCLC 70 and the PCLC 72 associated with the side plate 38, the cams 100 and 176 mounted at both ends of the square shafts 54 and 56 respectively, are rotated between the inactive and active positions to move the metering blade 90 and the pressure blade 166 between inoperative and operative positions respectively. By providing cams and cam follower rollers at both ends of the apparatus 10, the movement of the blades into and out of pressure engagement with the applicator roller is maintained uniform so as to avoid any twisting or tilting of the blades as might result if the blades were actuated by a single control means provided at only one end of the apparatus.

In the operation of the developer apparatus 10, the lever 140 is manually moved in a counterclockwise direction from the position shown in FIG. 3 to a first position, thereby rotating the cams 100 and 176 to the active position and slidably moving the metering blade 90 and the pressure blade 166 to the operative position in pressure engagement with the surface of the applicator roller 30. The cams 100 and 176 provide for the metering cam 100 to act against the metering cam follower roller 98 in advance of the pressure cam 176 acting against the pressure cam follower roller 174 to cause the metering blade 90 to move into pressure engagement with the applicator roller 30 in advance of the pressure blade 166. This sequential movement of the blades permits the metering blade 90 to meter the liquid developer uniformly on the surface of the applicator roller prior to movement of the pressure blade 166 to its operative position against the applicator roller.

In response to movement of the lever 140 to the first position, the first lobe 180 of the pressure cam 176 acts against the pressure cam follower roller 174. This position of the pressure cam 176 is suited to the pressure blade 166 exerting the proper amount of pressure against the applicator roller 30 for developing diazotype film. The exposed film is fed through the developing zone between the applicator roller 30 and the pressure blade 166 whereat the pressure blade presses the film against the surface of the applicator roller to transfer the liquid developer from the surface of the roller to the film to develop an image thereon.

When the metering blade 90 and the pressure blade 166 are in their operative positions, the resiliency of the blades causes them to be deflected or bowed slightly as they exert pressure against the surface of the applicator roller 30. Also, the resiliency of the blades provides a biasing action to urge and maintain the cam follower rollers against the cams when the cams are disposed in their active position.

In the development of diazotype copy paper in place of film, the lever 140 is manually moved in a further counterclockwise direction, as viewed in FIG. 3, to a second position thereby imparting further rotative movement to the cams 100 and 176. Because the lobe 104 of the metering cam 100 is uniform, this further movement of the metering cam 100 does not affect the position of the metering cam follower roller 98. Therefore, the setting of the pressure of the metering blade 90 against the applicator roller 30 remains unchanged. However, the further rotation of the pressure cam 176 results in the second lobe 182 being moved to a position against the pressure cam follower roller 174, thereby imparting additional movement to the slide means 152 and causing the pressure blade 166 to exert an increased amount of pressure against the applicator roller 30. As stated supra, this additional pressure applied by the pressure blade 166 against a copy sheet fed through the developing zone provides for the development of high quality images on copy paper.

On completion of the development operation, the lever 140 is manually moved in the opposite direction to the position shown in FIG. 3. This movement of the lever rotates the cams in a clockwise direction, from the active to the inactive position, whereby the lobes of the cams are moved out of working relation with the cam follower rollers and the pressure of the metering and pressure blades against the applicator roller is relieved.

From the foregoing, it will be appreciated that the present invention provides a developer apparatus comprising a manually operable control means for slidably positioning the metering and pressure blades into pressure engagement with the applicator roller, thereby reducing the torque requirements associated with the prior art devices for positioning the blades. The two positions of the pressure can permit the development of either film or copy paper, with but a single initial setting of the cams, without the necessity of independently adjusting the blades for different types of copy media. Further, the protective cover associated with each of the blades extends the useful life of the blades by minimizing undue wear thereto, permits fabricating blades at less cost as a result of eliminating a polishing operation of the blades and reduces servicing problems created as a result of worn blades.

What is claimed is:

1. An apparatus for developing diazotype copy material, comprising:

roller means for applying liquid developer to copy material to be developed;

means for applying liquid developer to the roller means;

blade means supported for sliding movement between an inoperative position and an operative position in pressure contact with the roller means for metering the liquid developer on the roller means and for pressing copy material against the roller means for development;

control means operatively associated with the blade means for moving the blade means between the inoperative and the operative positions;

slide means for mounting the blade means adjacent the roller means;

support means for mounting the slide means to maintain the blade means at an angular position with respect to the axis of the roller means;

means for adjusting the support means to position the blade means at a selectively settable position with respect to a longitudinal line of contact of the blade means with the roller means; and actuating means for manually operating the control means.

2. An apparatus as set forth in claim 1 further comprising:

means for adjusting the control means to selectively control the amount of pressure applied by the blade means to the roller means in response to movement of the blade means to the operative position.

3. An apparatus as set forth in claim 1 further comprising:

cover means for protecting the blade means mounted on the slide means intermediate the blade means and the roller means.

4. An apparatus as set forth in claim 1 in which the control means comprises:

cam means mounted for movement between an inactive and an active position;

cam follower means mounted on the slide means and acted upon by the cam means for moving the blade means from the inoperative to the operative position in response to movement of the cam means from the inactive to the active position; and linkage means for moving the cam means between the inactive and active positions in response to operation of the actuating means.

5. An apparatus as set forth in claim 4 in which the blade means comprises a resilient member for urging the cam follower means in a direction to be acted upon by the cam means in response to operation of the blade means to the operative position.

6. An apparatus as set forth in claim 1 further comprising;

cam means operable between an inactive and an active position for moving the blade means from the inoperative to the operative position; and a fulcrum plate for mounting the actuating means coaxially with the roller means;

said control means comprising linkage means interconnecting the cam means and the fulcrum plate for operating the cam means between the inactive and active positions in response to operation of the actuating means.

7. An apparatus as set forth in claim 1 in which the blade means comprises a metering blade and a pressure blade, said control means comprising:

a first cam means operable between an inactive and an active position for moving the metering blade from the inoperative to the operative position;

a second cam means operable between an inactive and an active position for moving the pressure blade from the inoperative to the operative position; and linkage means interconnecting the first and second cam means with the actuating means;

whereby operation of the actuating means operates the first and the second cam means between the inactive and the active positions.

8. An apparatus as set forth in claim 7 further including means for sequentially moving the metering and pressure blades between the inoperative and operative positions, said slide means associated with each of said metering and pressure blades, comprising:

cam follower means mounted on each said slide means, each said cam follower means being acted upon by the first and a second cam means respectively, in response to operation of the first and second cam means to the active position;

said first cam means acting upon the cam follower means associated with the metering blade in advance of the second cam means acting upon the cam follower means associated with the pressure blade.

9. An apparatus as set forth in claim 1 in which the control means includes means for varying the amount of pressure applied by the blade means to the roller means in response to movement of the blade means to the operative position, comprising:

cam means mounted for movement between a first and a second active position;

a first and a second lobe provided on the cam means; and cam follower means associated with the blade means and acted upon by the cam means in response to movement of the cam means to the first and second active positions;

said actuating means operable to a first position for moving the cam means to the first active position in which the first lobe acts against the cam follower means for moving the blade means to the operative position for applying a first amount of pressure to the roller means, and operable to a second position for moving the cam means to the second active position in which the second lobe acts against the cam follower means for moving the blade means to the operative position for applying pressure to the roller means in an amount greater than the first amount of pressure.

10. An apparatus for developing diazotype copy material by applying thereto a metered quantity of liquid developer, comprising;

an applicator roller having a surface adapted to retain a metered quantity of liquid developer thereon;

means for supplying liquid developer to the applicator roller;

blade means slidably positionable between an inoperative position and an operative position in pressure contact with the roller surface comprising a metering blade for metering the liquid developer on the roller surface and a pressure blade for pressing copy material against the roller surface to transfer a metered amount of liquid developer from the roller surface to the copy material for development;

slide means for mounting the blade means for movement between the inoperative and operative positions;

cam means mounted for movement between an inactive position and an active position;

cam follower means mounted on the slide means for moving the blade means from the inoperative to the operative position in response to movement of the cam means from the inactive to the active position;

linkage means interconnecting the cam means for moving the cam means between the inactive and active positions; and lever means for manually operating the linkage means.

11. An apparatus for developing diazotype copy material, comprising:

an applicator roller having a surface for applying a metered amount of liquid developer to a copy sheet to be developed;

means for supplying liquid developer to the applicator roller;

a metering blade mounted at an angular position with respect to the roller surface for sliding movement between an inoperative position and an operative position in pressure contact with the roller surface;

a pressure blade mounted at an angular position with respect to the roller surface, in diametrically opposed relation with the metering blade, for sliding movement between an inoperative position out of contact with the roller surface and an operative position in pressure contact with the roller surface;

cam means operable between an inactive position and an active position for sliding the metering and pressure blades from their inoperative to their operative positions respectively;

linkage means interconnecting the cam means for operating the cam means between the inactive and active positions; and actuating means for manually operating the linkage means.

* * * * *